US005204189A

United States Patent [19]

Ueyama et al.

[11] Patent Number: 5,204,189

[45] Date of Patent: Apr. 20, 1993

[54] HEAT-SENSITIVE TRANSFERRING RECORDING MEDIUM

[75] Inventors: Seiji Ueyama, Hirakata; Hiroyasu Onoe, Ikoma, both of Japan

[73] Assignee: General Company Limited, Osaka, Japan

[21] Appl. No.: 408,951

[22] Filed: Sep. 18, 1989

Related U.S. Application Data

[63] Continuation of Ser. No. 271,406, Nov. 14, 1988, abandoned, which is a continuation of Ser. No. 112,965, Oct. 27, 1987, abandoned, which is a continuation of Ser. No. 759,858, Jul. 29, 1985, abandoned.

[30] Foreign Application Priority Data

Mar. 12, 1985 [JP] Japan ..... 60-47400

[51] Int. Cl.[5] ..... B41M 5/26

[52] U.S. Cl. ..... 428/484; 428/195; 428/483; 428/488.1; 428/488.4; 428/500; 428/522; 428/523; 428/913; 428/914

[58] Field of Search ..... 428/484, 488.1, 488.4, 428/913, 914, 195, 483, 500, 522, 523

[56] References Cited

U.S. PATENT DOCUMENTS 4,567,113 1/1986 Ohtsu et al. ..... 428/480
4,572,860 2/1986 Nakamura et al. ..... 428/483

*Primary Examiner*—Pamela R. Schwartz
*Attorney, Agent, or Firm*—Wegner, Cantor, Mueller & Player

[57] ABSTRACT

A heat-sensitive transferring recording medium comprises a substrate and a solid coating film form by applying a coating material mainly composed of an emulsion and a coloring agent overlying the substrate.

5 Claims, No Drawings

HEAT-SENSITIVE TRANSFERRING RECORDING MEDIUM

This application is a continuation of Ser. No. 271,406, filed Nov. 14, 1988 (now abandoned), which is a continuation of U.S. Ser. No. 112,965, filed Oct. 27, 1987 (now abandoned), which is a continuation of U.S. Ser. No. 759,858, filed Jul. 29, 1985 (now abandoned).

BACKGROUND OF THE INVENTION

1. Field of the Invention

This invention relates to a heat-sensitive transferring recording medium used for heat-sensitive transferring recording apparatuses such as thermal facsimile, thermal printer and the like.

2. Description of the Prior Art

Heat-sensitive recording system which is of non-impact type has recently drawn attention since the system is free of noise and can be easily handled.

Indeed, conventional heat-sensitive recording systems are free of noise and neither development nor fixation of the images is necessary and, in addition, the handling is easy, but the resulting record is liable to be falsified and its durability is not so good.

For the purpose of solving these drawbacks, a particular heat-sensitive transferring recording method was proposed. That is, a heat melting layer is provided on a substrate, and said ink layer is contacted with a receiving paper (recording paper) followed by heating with a thermal head through the substrate to melt said ink layer resulting in transferring of the heated portion to a receiving paper which is an ordinary paper.

The above-mentioned heat-sensitive transferring recording method can give good printed letters where the smoothness of the receiving paper which is an ordinary paper is high, but where the smoothness is low, for example, the Bekk smoothness test value is not higher than 50 sec., the heat melting ink layer contacts the receiving paper at some portion while said layer does not contact the receiving paper at other portions, because of the uneven surface of the receiving paper. This results in a low transferring effeciency, formation of void, and low sharpness. In addition, since the heat melting ink has a high fluidity, the ink penetrates into the inside of the receiving paper so that the density of the printed letters is low and good printed letters can not be obtained.

In conventional ink manufacturing methods, a hot melt type coating material or an organic solvent type coating material is used and the content of resin components is at most 20% by weight. In the case of hot melt ink, the more the content of resin component, the higher is the melt viscosity, and thereby coating is not possible.

In the case of organic solvent type inks, it is difficult to dissolve or disperse waxes and, further, remove the organic solvent from the wax dissolved or dispersed in the organic solvent for drying.

SUMMARY OF THE INVENTION

An object of the present invention is to provide a heat-sensitive transferring recording medium free from the above-mentioned drawbacks.

Another object of the present invention is to provide a heat-sensitive transferring recording medium capable of forming clear printed images of high density, less void and having sharp outline.

According to the present invention, there is provided a heat-sensitive transferring recording medium which comprises a substrate and a solid coating film formed by applying a coating material mainly composed of an emulsion and a coloring agent overlying the substrate.

DESCRIPTION OF THE PREFERRED EMBODIMENTS

In order to obtain printed letters of high density and less void on a paper of low smoothness, it is necessary to make the transferring layer in a form of block, and use a heat-sensitive transferring ink layer of high melt viscosity so as to decrease penetration of the ink into the paper. That is, the transferring is not effected in a form of point, but in a form of plane. For effecting such plane-like transferring, a heat-sensitive transferring ink layer containing a larger amount of resin components is necessary in place of conventional heat-sensitive transferring ink layers mainly composed of waxes of low heat melting viscosity.

The substrate used in the present invention includes a thin paper of, for example, less than 20 $\mu$ thick, such as glassine paper, condenser paper and the like, and a heat resistant film of, for example, less than 10$\mu$ thick, such as polyester, polyimide, nylon, polypropylene and the like. Plastic films of 2–10$\mu$ thick are preferable.

The emulsion used in the present invention includes wax emulsion, for example, emulsion of a wax such as paraffin wax, microcrystalline wax, carbnauba wax, shellac wax, montan wax, higher fatty acids, higher fatty acid amides, metallic soaps of higher fatty acids and the like.

Further, resin emulsion also can be used as the emulsion of the present invention. Representative resin emulsions are polyethylene resin emulsion, ethylene-vinyl acetate copolymer emulsion, vinyl acetate resin emulsion, vinyl acetate-vinyl chloride copolymer emulsion, acrylic resin emulsion and the like.

Coloring agent used in the present invention includes pigments such as carbon black, iron oxides, prussian blue, lake red, titanium oxide and the like, and dyes such as basic dye, neozapon dye and the like.

As the heat resistant protective layer for the substrate, there may be used higher fatty acids, fluorocarbon polymers, silicone resin and the like.

The heat-sensitive transferring recording medium may be produced as shown below. The above-mentioned resin emulsion or wax emulsion and a coloring agent are dispersed in water by a dispersing machine such as ball-mill, attritor and the like. In the case of using a commercially available color agent dispersion as the coloring agent, it is necessary only to mix and stirr simply the above-mentioned components. The resulting ink coating material is applied to a substrate by means of an ordinary coating machine and dried. When the heat resistant protective layer is formed on the surface of the substrate opposite to the ink layer, the above material is mixed with and dispersed in a solvent, applied to the substrate and dried. The thickness of the heat-sensitive transferring layer may be 2–10$\mu$.

For the purpose of decreasing the energy necessary for thermal heads, it is effective to provide a heat-sensitive releasing layer between the substrate and the ink layer. The releasing layer may be formed by using silicone, celluloses and waxes, alone or in combination, if desired, a pigment such as carbon black, calcium carbonate, clay, talc and the like is dispersed in the above-mentioned materal for a releasing layer.

In case that the heat-sensitive releasing layer is provided on the heat-sensitive transferring recording medium, the above-mentioned material is applied to the substrate by means of hot melt coating or solvent coating and dried before applying the heat-sensitive transferring ink layer.

According to the present invention, since the melting temperature of the transferring ink layer is so high that penetration of the ink into the receiving paper is little and thereby the printed letter is of high density, and the transferring is effected in a form of block so that void is few, and in addition, the film shapeability is so weak that the printed letters have a sharp outline and are clear.

Further, according to the present invention where emulsion type coating materials are used, there can be produced a resin/wax/coloring agent ink containing more resin content than the prior art ink. Since the emulsion type coating material gives a heat-sensitive transferring ink layer having a less film shapeability than that produced from a hot melt organic solvent type coating material and therefore, printed letters of sharp outline can be obtained when printed by means of a thermal head.

EXAMPLES

Reference Example

| | |
|---|---|
| Paraffin wax | 40 parts by weight |
| Carnauba wax | 30 parts by weight |
| Ethylene-vinyl acetate copolymer (90:10) | 10 parts by weight |
| Carbon black | 20 parts by weight |

An ink composed of the above-mentioned ingredients was applied to a polyester film of 6μ thick in the thickness of 4μ by means of hot melt coating.

Example 1

| | Amount (parts by weight) | Solid content (%) |
|---|---|---|
| Ethylene-vinyl acetate (90:10) copolymer emulsion (solid content, 45%) | 30 | 39.1 |
| Paraffin emulsion (solid content, 30%) | 30 | 26.1 |
| Carnauba emulsion (solid content, 30%) | 20 | 17.4 |
| Carbon black dispersion (solid content, 30%) | 20 | 17.4 |

An ink composed of the above-mentioned ingredients was applied to a polyester film of 6μ thick and dried to produce a heat-sensitive transferring ink layer of 4μ thick.

Example 2

A paraffin wax (m.p. 65° C.) was applied to a polyester film of 6μ thick in the thickness of 1μ by hot melt coating.

To the surface of the resulting paraffin wax layer was applied an ink composed of the following ingredients:

| | Amount (parts by weight) | Solid content (%) |
|---|---|---|
| Ethylene-vinyl acetate (90:10) copolymer emulsion (solid content, 45%) | 60 | 6.2 |
| Carnauba emulsion (solid content, 30%) | 20 | 15.4 |
| Carbon black dispersion (solid content 30%) | 20 | 15.4 |

by Mayer bar coating and dried to form a heat-sensitive transferring ink layer of 4μ thick.

TEST METHOD

The heat-sensitive transferring recording mediums as prepared above were tested by means of a heat-sensitive printer (cycle, 1.2 m sec.; applied pulse width, 0.9 m sec., power, 0.5 W/Dot) with a receiving paper (Bekk test, 16 sec; Hammer Mill Bond paper) (JIS P8119). The heat-sensitive transferring recording medium prepared in Reference Example gave many voids and low density while that prepared in each of Examples 1 and 2 gave good printed letters of few voids and high density.

What is claimed is:

1. A heat-sensitive transferring recording medium, comprising:
   - a substrate;
   - a solid coating film on said substrate, said solid coating film comprising:
     - a wax;
     - a resin; and
     - a coloring agent, the resin providing 39.1–69.2% of the solid content of the solid coating film;
   - the solid coating film having been formed by application of an aqueous dispersion including the wax, resin and coloring agent to the substrate, followed by drying.

2. A heat-sensitive transferring recording medium as claimed in claim 1, wherein the substrate is formed of a plastic film and a heat resistive protective layer on the plastic film, opposite the solid coating film.

3. A heat-sensitive transferring recording medium as claimed in claim 1, further comprising a heat-sensitive releasing layer between the substrate and the solid coating film.

4. A heat-sensitive transferring recording medium as claimed in claim 1, wherein the wax is at least one member selected from the group consisting of paraffin wax, microcrystalline wax, carnauba wax, shellac wax, montan wax, higher fatty acids, higher fatty acid amides and metallic soaps of higher fatty acids.

5. A heat-sensitive transferring recording medium as claimed in claim 1, wherein the resin is at least one member selected from the group consisting of polyethylene resin, ethylene-vinylacetate copolymer, vinylacetate resin, vinylacetate-vinylchloride copolymer and acrylic resin.

* * * * *